US005406276A

United States Patent [19]

Ogle

[11] Patent Number: 5,406,276

[45] Date of Patent: Apr. 11, 1995

[54] CROSS-WALK WARNING LIGHT SYSTEM

[76] Inventor: Terry B. Ogle, 1341 Dolly Parton Pkwy., Sevierville, Tenn. 37862

[21] Appl. No.: 911,080

[22] Filed: Jul. 9, 1992

[51] Int. Cl.[6] ..... G08G 1/095

[52] U.S. Cl. ..... 340/944; 340/925

[58] Field of Search ..... 340/908.1, 925, 944; 116/63 R

[56] References Cited

U.S. PATENT DOCUMENTS

| | | | |
|---|---|---|---|
| 2,700,754 | 1/1955 | McCullough . | |
| 3,199,073 | 8/1965 | Hilliker | 340/925 |
| 4,025,922 | 5/1977 | Trawick, III | 340/407 |
| 4,570,207 | 2/1986 | Takahashi et al. | 362/152 |
| 4,590,474 | 5/1986 | Patterson et al. | 340/925 |
| 5,103,223 | 4/1992 | Humphrey | 340/944 |

FOREIGN PATENT DOCUMENTS

| | | | |
|---|---|---|---|
| 0712131 | 9/1931 | France | 340/944 |
| 3407929 | 9/1985 | Germany | 340/944 |
| 8700326 | 1/1987 | WIPO | 340/925 |

*Primary Examiner*—Brent Swarthout

*Attorney, Agent, or Firm*—Pitts & Brittian

[57] ABSTRACT

A cross-walk warning light system for warning drivers that a pedestrian has entered a cross-walk by shining a light, preferably a laser, having a beam parallel to the cross-walk. The cross-walk warning light system detects a pedestrian entering the cross-walk and activates a light that is aimed across the intersection, thus the driver sees this beam of light, which is projected across the intersection and is warned of the presence of a pedestrian in the cross-walk. The cross-walk warning light system is timed so as to deactivate the light after a predetermined interval of time. In the preferred embodiment, a first and an adjacent laser are spaced apart a distance substantially the width of the crosswalk, provide parallel beams of light on each side of the cross-walk. Also in the preferred embodiment, a second laser, disposed at the opposite end of the crosswalk, provides a second beam of light, aimed substantially co-linearly with the first. This allows at least a partial beam of light at each end of the cross-walk in the event a pedestrian blocks the first laser beam.

12 Claims, 3 Drawing Sheets

CROSS-WALK WARNING LIGHT SYSTEM

TECHNICAL FIELD

This invention relates to the field of cross-walk warning lights. More specifically, it relates to a light system for warning drivers that a pedestrian is in an intersection or non-intersection cross-walk.

BACKGROUND ART

Pedestrian traffic as well as automobile traffic makes use of intersections in urban and suburban streets. As pedestrians travel from one location in a city to another, they are faced with many intersections which must be crossed. In order to assist the pedestrians in crossing safely, the familiar "WALK", "DON'T WALK" signs are linked to standard motor-traffic controls. This allows pedestrians to, ideally, cross with, rather than against, the flow of automobile traffic. While these controls, i.e. "WALK", "DON'T WALK" signs, warn pedestrian traffic of the safest opportunity to cross the intersection, they do not prevent a pedestrian from crossing against the light, i.e. entering the intersection when oncoming traffic has a "green light".

Also many urban areas and resort areas that have an especially heavy flow of pedestrian traffic have non-intersection cross-walks, i.e. cross-walks between intersections in which pedestrians always have the right of way. There are presently no warning light systems that warn oncoming traffic that a pedestrian is attempting to cross against the light or has entered a non-intersection cross-walk and is presently in the cross-walk. This need is most acute during periods of poor visibility when an alert driver would experience difficulty in spotting pedestrians.

Accordingly, it is an object of this invention to provide a cross-walk warning light system that is able to detect when a pedestrian has entered the cross-walk and accordingly activate lights that warn oncoming traffic of the presence of a pedestrian in the cross-walk.

It is another object of this invention to provide a cross-walk warning light system that provides warning lights that are highly visible to oncoming traffic during periods of poor visibility, such as fog or inclement weather.

Other objects and advantages over the prior art will become apparent to those skilled in the art upon reading the detailed description together with the drawings as described as follows.

DISCLOSURE OF THE INVENTION

In accordance with the various features of this invention, a cross-walk warning light system is provided. The cross-walk warning light system detects a pedestrian entering the cross-walk and activates a light that is aimed across the street in order to project a beam of light from one end of the cross-walk to the other, thus the driver sees this beam of light and is warned of the presence of a pedestrian in the cross-walk. While any focused beam of light would suffice, a laser is the preferred light source. The light system is timed so as to deactivate the laser after a predetermined interval of time. In the preferred embodiment, two lasers, which are spaced apart a distance substantially the width of the crosswalk, provide parallel beams of light on each side of the cross-walk. Also in the preferred embodiment, a second laser, disposed at the opposite end of the cross-walk, provides a second beam of light, aimed substantially co-linearly with the first. This allows at least a partial beam of light at each end of the cross-walk in the event a pedestrian blocks the first laser beam. Also in the preferred embodiment, a pulsed yellow "caution" light beam would immediately precede a continuous red "stop" beam.

BRIEF DESCRIPTION OF THE DRAWINGS

The above mentioned features of the invention will become more clearly understood from the following detailed description of the invention read together with the drawings in which:

FIGS. 2 and 3 are enlarged relative to the size shown in FIG. 1 to better illustrate elements of the present invention.

Figure 1:
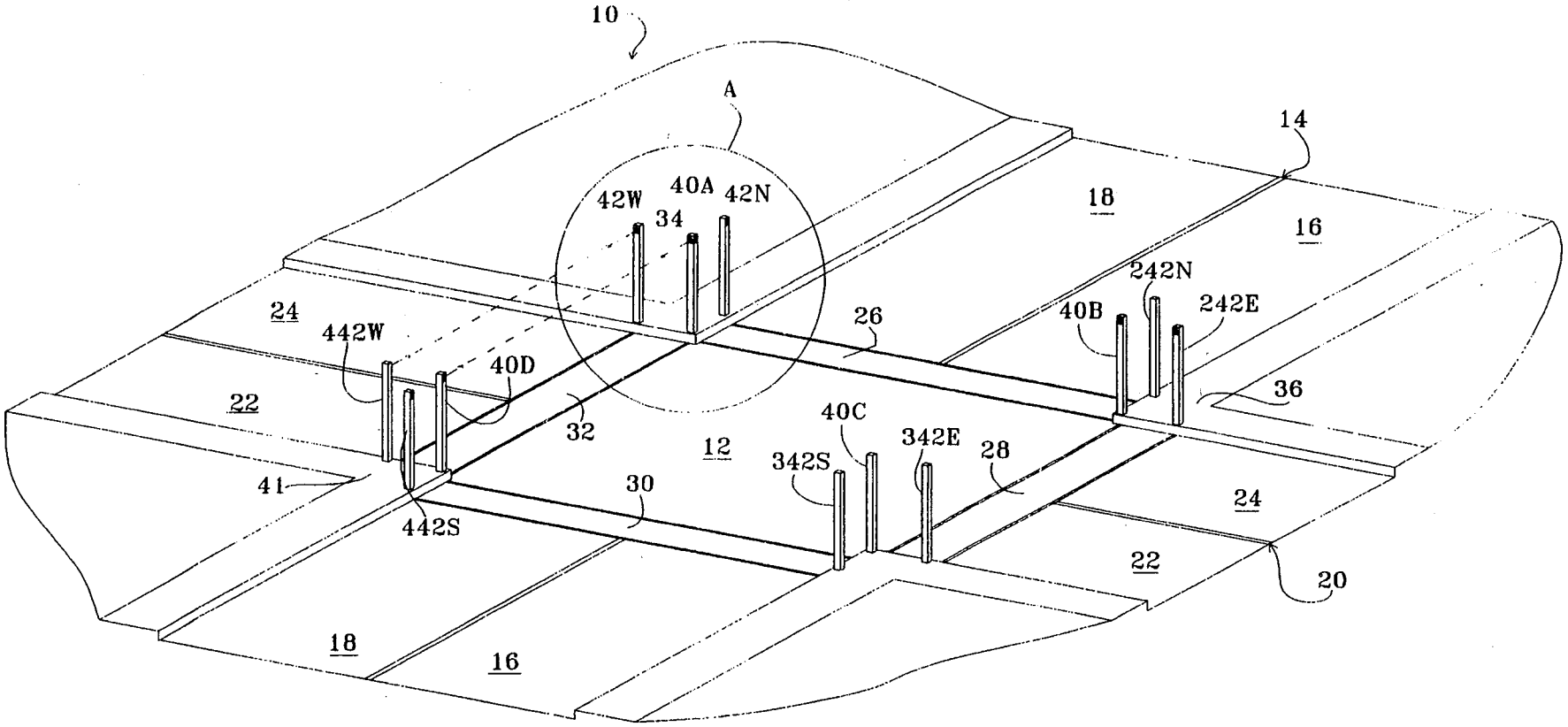
FIG. 1 illustrates a perspective view of an intersection equipped with the cross-walk warning light system of the present invention.

Best Mode for Carrying out the Invention

A cross-walk warning light system constructed in accordance with the present invention is illustrated generally as 1O in the Figures. For convenience and ease of illustration, the cross-walk warning light system is shown on an intersection 12 which consists of the junction of a first street 14, having a north bound lane 16 and a south bound lane 18, and a second street 20, having an east bound lane 22 and a west bound lane 24. To facilitate pedestrian traffic, intersection 12 also has a northern cross-walk 26, an eastern cross-walk 28, a southern cross-walk 30 and a western cross-walk 32. Northern cross-walk 26 extends from northwestern corner 34 to northeastern corner 36. Likewise western cross-walk 32 extends from northwestern corner 34 to southwestern corner 41. It will be understood that references to direction are not intended to limit the disclosure, but are for ease of illustration. It will be further understood that intersection 12 could be equipped with standard traffic controls, such as the familiar red-yellow-green traffic lights (not shown) and could also be equipped with typical pedestrian controls, such as the familiar "WALK"—"DON'T WALK" signs (not shown).

Figure 2:
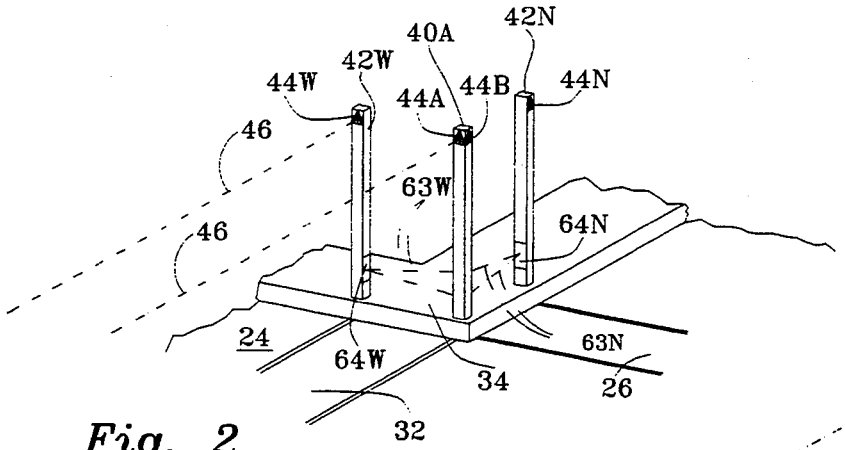
FIG. 2 illustrates a perspective view thereof taken at circle A of FIG. 1.
Figure 3:
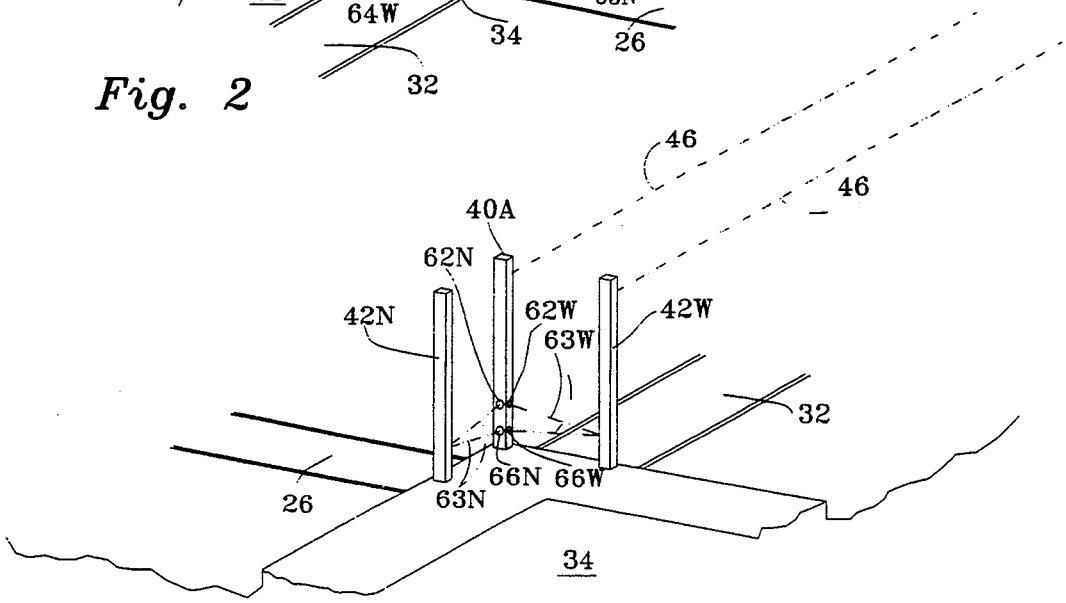
FIG. 3 illustrates a rear perspective view thereof taken at circle A of FIG. 1.

As a pedestrian enters a cross-walk, an emitter 44 emits a beam of light 46 across the cross-walk so as to be visible to oncoming traffic. Preferably, emitter 44 emits a focused beam of light and most preferably, emitter 44 is a laser emitter that emits a laser beam. Also in the preferred embodiment, emitter 44 emits a pulsatile yellow "caution" beam immediately followed by a red "stop" beam. Emitter 44 is carried by a support pole 40, which is disposed at each corner. As can be seen in FIG. 2 and 3, support pole 40A is located on northwest corner 34. Support pole 40A carries two emitters, 44A, which is associated with western cross-walk and 44B, which is associated with northern cross-walk 26. It will be understood that support poles 40B, 40C and 40D also carry two emitters in like fashion. Preferably, each emitter carried by support poles 40A, 40B, 40C and 40D is aimed co-linearly with the other emitter associated with the same cross-walk, thus forming opposing pairs of emitters associated with each cross-walk.

In the preferred embodiment support pole 42N is disposed a distance approximately equal the width of the northern cross-walk, to the north of support pole 40A. Support pole 42N also carries an emitter 44 which is associated with northern cross-walk 26. Support pole 42W is disposed a distance approximately the width of the western cross-walk, to the west of support pole 40A. In the preferred embodiment, support pole 42W also carries an emitter 44 which is associated with western cross-walk 32. While a specific support pole has been illustrated in the figures, it will be understood by those skilled in the art that an emitter 44 could be carried by an existing pole such as is used to carry any existing traffic/pedestrian control.

Figure 5:
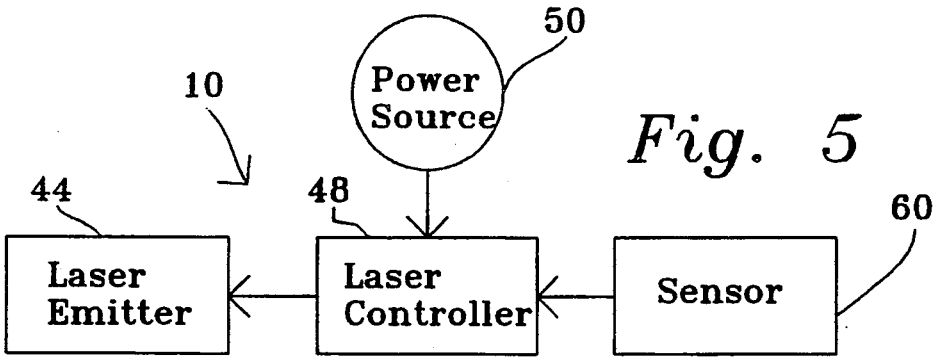
FIG. 5 illustrates a block diagram of the cross-walk warning light system of the present invention.

In FIG. 5 a block diagram is shown in which emitter 44 is controlled by laser controller 48, which receives signals from sensor 60. The system 10 is energized by power source 50. It will be recognized by those skilled in the art that power source 50 could be hardwired to the same power source as traffic controls, hardwired directly to main power leads, battery powered or solar generated through an array of solar cells.

Sensor 60 could in one embodiment be any type of motion sensor, a sensor pad such as is used by some automatic doors or even could be a manual push-button type device activated by the pedestrian. However, in the preferred, illustrated, embodiment, sensor 60 is an infrared light (IR) source 62, reflector 64 and IR detector 66. This type of sensor operates on the "broken beam" principle, i.e. a signal is generated by IR detector 66, in a negative feedback manner when IR beam 63 is broken and no longer detected by IR detector 66.

Reference is made to FIGS. 2 and 3 which illustrate an enlarged view of northwest corner 34. It will be understood that the configuration illustrated in FIGS. 2 and 3 and described below is, similarly, installed on the other respective corners, as is illustrated in FIG. 1. In the preferred embodiment, IR sources 62N and 62W are mounted a small distance, i.e. approximately 12–18 inches, above the ground on support pole 40. IR source 62N is focused towards reflector 64N, which is carried by support pole 42N. Likewise, IR source 62W is focused towards reflector 64W, which is carried by support pole 42W. IR source 62N emits IR beam 63N, which is then reflected by reflector 64N towards IR detector 66N. As a pedestrian steps into the northern cross-walk 26, IR beam 63N is momentarily broken. This causes sensor 60 to generate a signal which in turn causes laser controller 48 to activate emitter 44B and 44N. Similarly, if a pedestrian steps into the western cross-walk 32, IR beam 63W is momentarily broken. This causes sensor 60 to generate a signal which in turn causes laser controller 48 to activate emitter 44A and, in the preferred embodiment, 44W.

In a more preferred embodiment, laser controller 48 also activates the emitter carried by support pole 40D that is associated with western cross-walk 32 and the emitter carried by support pole 442W simultaneously with emitters 44A and 44W. Thus in the most preferred embodiment, opposing emitters, i.e. emitters that are aimed co-linearly and are associated with the same cross-walk, are activated simultaneously. This most preferred arrangement substantially prevents a light beam from being blocked by a pedestrian stepping in its path.

Figure 6:
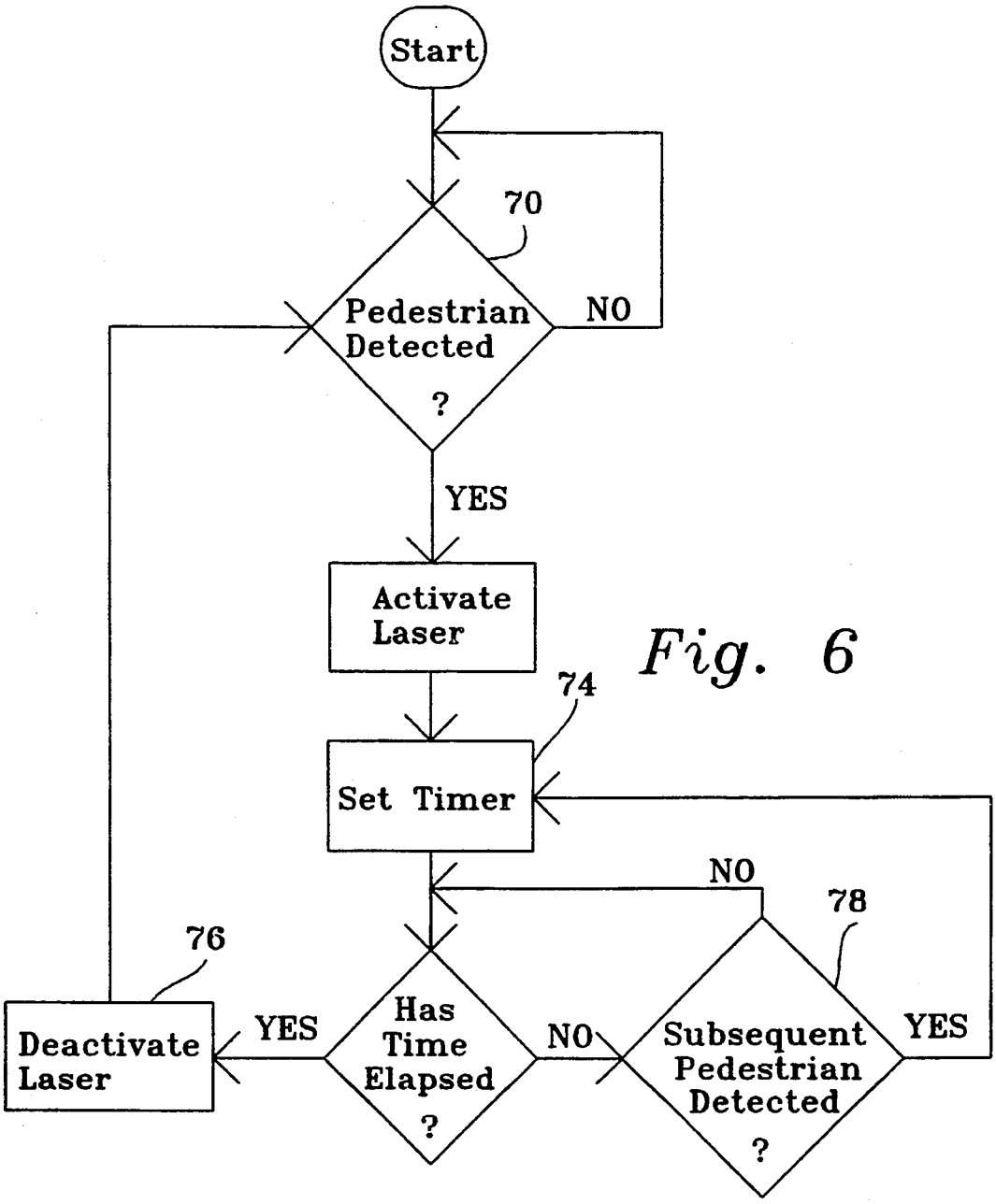
FIG. 6 a flow chart illustrating the operation of the controller of the warning light system of the present invention.

In addition to activating the various emitters, laser controller 48 also deactivates the laser emitters after a predetermined amount of time. In FIG. 6, a flow diagram illustrates the operation of laser controller 48. If a pedestrian is detected 70 by sensor 60, laser controller activates laser and sets a timer at 74. If the predetermined amount of time elapses prior to a subsequent pedestrian being detected, then the laser is deactivated 76. However, if a subsequent pedestrian is detected entering the cross-walk 78, the timer is re-set 74. In this fashion, laser controller 48 doesn't deactivate an emitter while a pedestrian is in the cross-walk.

Figure 4:
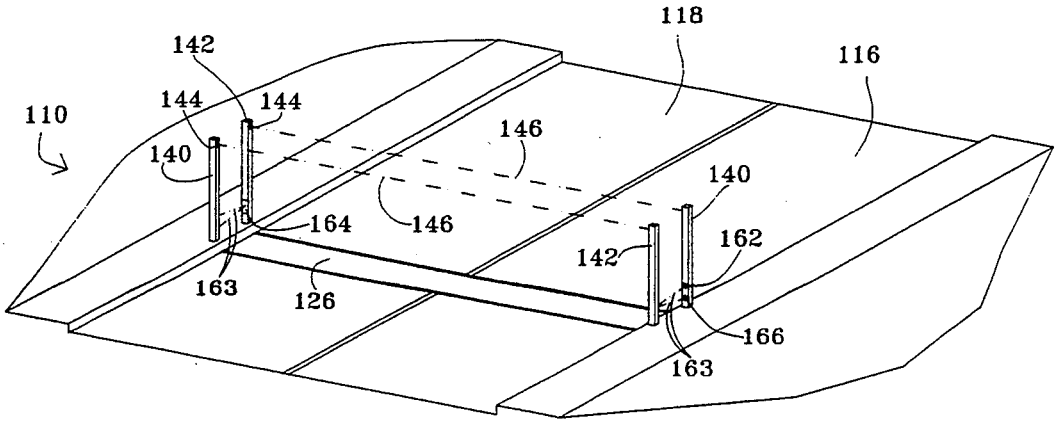
FIG. 4 illustrates perspective view of an alternate embodiment of the cross-walk warning light system of the present invention installed at a non-intersection cross-walk.

An alternate embodiment of the present invention is illustrated in FIG. 4, in which cross-walk warning light system 110 is positioned at a non-intersection cross-walk. In system 110 emitter 144 is carried by support pole 140 and a second emitter 144 is carried by an adjacent support pole 142. IR source 162, IR beam 163, reflector 164 and IR detector 166 each function in the same manner as IR source 62, IR beam 63, reflector 64 and IR detector 66, respectively, in FIGS. 1–3. Thus two light beams 146 are emitted across the length of cross-walk 126 which extends perpendicular to lanes 118 and 116.

From the foregoing description, it will be recognized by those skilled in the art that a cross-walk warning light system offering advantages over the prior art has been provided. Specifically, the cross-walk warning light system provides a system that is able to detect when a pedestrian has entered the cross-walk and accordingly activate lights that warn oncoming traffic of the presence of a pedestrian in the cross-walk and also provides warning lights that are highly visible to oncoming traffic during periods of poor visibility, such as fog or inclement weather.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A crosswalk warning light system for giving visual indication to motor traffic on a selected road that at least one pedestrian is within a crosswalk crossing the selected road, the crosswalk terminating at first and second ends on either side of the road and defining first and second side boundaries, said crosswalk warning light system comprising:

a power supply;

a first emitter support member disposed at said first end of said crosswalk proximate said first side boundary, said first emitter support member having an upper end and a lower end;

a first emitter carried by said upper end of said first emitter support member for projecting at least a portion of said visual indication across said road in a direction substantially parallel to said crosswalk and proximate said first side boundary, said portion of said visual indication including at least a first beam of light;

a second emitter support member disposed at said second end of said crosswalk proximate said first side boundary, said second emitter support member having an upper end and a lower end;

a second emitter carried by said upper end of said second emitter support member for projecting at least a portion of said visual indication across said road in a direction substantially parallel to said crosswalk and proximate said first side boundary, said portion of said visual indication including at least a second beam of light;

a third emitter support member disposed at said first end of said crosswalk proximate said second side boundary, said third emitter support member having an upper end and a lower end;

a third emitter carried by said upper end of said third emitter support member for projecting at least a portion of said visual indication across said road in a direction substantially parallel to said crosswalk and proximate said second side boundary, said portion of said visual indication including at least a third beam of light;

a sensor for detecting at least one pedestrian entering said crosswalk at either of said first and second ends of said crosswalk; and a controller for activating and deactivating said first emitter, said second emitter and said third emitter, said controller activating said first emitter, said second emitter, and said third emitter upon detection by said sensor of at least one pedestrian entering said crosswalk.

2. The crosswalk warning light system of claim 1 further comprising:

a fourth emitter support member disposed at said second end of said crosswalk proximate said second side boundary, said fourth emitter support member having an upper end and a lower end; and a fourth emitter carried by said upper end of said fourth emitter support member for projecting at least a portion of said visual indication across said road in a direction substantially parallel to said crosswalk and proximate said second side boundary, said portion of said visual indication including at least a fourth beam of light, said controller activating said fourth emitter upon detection by said sensor of at least one pedestrian entering said crosswalk.

3. The crosswalk warning light system of claim 1 wherein said first beam of light is a laser beam defining a selectable wavelength.

4. The crosswalk warning light system of claim 1 wherein said second beam of light is a laser beam defining a selectable wavelength.

5. The crosswalk warning light system of claim 1 wherein said third beam of light is a laser beam defining a selectable wavelength.

6. The crosswalk warning light system of claim 2 wherein said fourth beam of light is a laser beam defining a selectable wavelength.

7. A crosswalk warning light system for giving visual indication to motor traffic on a selected road that at least one pedestrian is within a crosswalk crossing the selected road, the crosswalk terminating at first and second ends on either side of the road and defining first and second side boundaries, said crosswalk warning light system comprising:

a power supply;

a first emitter support member disposed at said first end of said crosswalk proximate said first side boundary, said first emitter support member having an upper end and a lower end;

a first emitter carried by said upper end of said first emitter support member for projecting at least a portion of said visual indication across said road in a direction substantially parallel to said crosswalk and proximate said first side boundary, said portion of said visual indication including at least a first beam of light;

a second emitter support member disposed at said second end of said crosswalk proximate said first side boundary, said second emitter support member having an upper end and a lower end;

a second emitter carried by said upper end of said second emitter support member for projecting at least a portion of said visual indication across said road in a direction substantially parallel to said crosswalk and proximate said first side boundary, said portion of said visual indication including at least a second beam of light;

a third emitter support member disposed at said first end of said crosswalk proximate said second side boundary, said third emitter support member having an upper end and a lower end;

a third emitter carried by said upper end of said third emitter support member for projecting at least a portion of said visual indication across said road in a direction substantially parallel to said crosswalk and proximate said second side boundary, said portion of said visual indication including at least a third beam of light;

a fourth emitter support member disposed at said second end of said crosswalk proximate said second side boundary, said fourth emitter support member having an upper end and a lower end;

a fourth emitter carried by said upper end of said fourth emitter support member for projecting at least a portion of said visual indication across said road in a direction substantially parallel to said crosswalk and proximate said second side boundary, said portion of said visual indication including at least a fourth beam of light;

a sensor for detecting at least one pedestrian entering said crosswalk at either of said first and second ends of said crosswalk; and a controller for activating and deactivating said first emitter, said controller activating said first, second, third, and fourth emitters upon detection by said sensor of at least one pedestrian entering said crosswalk.

8. The crosswalk warning light system of claim 7 wherein said first beam of light is a laser beam defining a selectable wavelength.

9. The crosswalk warning light system of claim 7 wherein said second beam of light is a laser beam defining a selectable wavelength.

10. The crosswalk warning light system of claim 7 wherein said third beam of light is a laser beam defining a selectable wavelength.

11. The crosswalk warning light system of claim 7 wherein said fourth beam of light is a laser beam defining a selectable wavelength.

12. A crosswalk warning light system for giving visual indication to motor traffic on a selected road that at least one pedestrian is within a crosswalk crossing the selected road, the crosswalk terminating at first and second ends on either side of the road and defining first and second side boundaries, said crosswalk warning light system comprising:

a power supply;

a first emitter support member disposed at said first end of said crosswalk proximate said first side boundary, said first emitter support member having an upper end and a lower end;

a first emitter carried by said upper end of said first emitter support member for projecting at least a portion of said visual indication across said road in a direction substantially parallel to said crosswalk and proximate said first side boundary, said portion of said visual indication including at least a first laser beam defining a selectable wavelength;

a second emitter support member disposed at said second end of said crosswalk proximate said first side boundary, said second emitter support member having an upper end and a lower end;

a second emitter carried by said upper end of said second emitter support member for projecting at least a portion of said visual indication across said road in a direction substantially parallel to said crosswalk and proximate said first side boundary, said portion of said visual indication including at least a second laser beam defining a selectable wavelength;

a third emitter support member disposed at said first end of said crosswalk proximate said second side boundary, said third emitter support member having an upper end and a lower end;

a third emitter carried by said upper end of said third emitter support member for projecting at least a portion of said visual indication across said road in a direction substantially parallel to said crosswalk and proximate said second side boundary, said portion of said visual indication including at least a third laser beam defining a selectable wavelength;

a fourth emitter support member disposed at said second end of said crosswalk proximate said second side boundary, said fourth emitter support member having an upper end and a lower end;

a fourth emitter carried by said upper end of said fourth emitter support member for projecting at least a portion of said visual indication across said road in a direction substantially parallel to said crosswalk and proximate said second side boundary, said portion of said visual indication including at least a fourth laser beam defining a selectable wavelength;

a sensor for detecting at least one pedestrian entering said crosswalk at either of said first and second ends of said crosswalk; and a controller for activating and deactivating said first emitter, said controller activating said first, second, third, and fourth emitters upon detection by said sensor of at least one pedestrian entering said crosswalk.

* * * * *